United States Patent [19]

Jeffries

[11] Patent Number: 4,688,282

[45] Date of Patent: Aug. 25, 1987

[54] BEDDING FOR CHILDREN

[76] Inventor: Deidra B. Jeffries, 811 Juana Ave., San Leandro, Calif. 94577

[21] Appl. No.: 890,320

[22] Filed: Jul. 29, 1986

[51] Int. Cl.[4] ..... A47C 29/00

[52] U.S. Cl. ..... 5/413; 5/494; 2/69.5

[58] Field of Search ..... 5/413, 421, 494, 496; 128/134; 2/69, 69.5, 83

[56] References Cited

U.S. PATENT DOCUMENTS

| | | | |
|---|---|---|---|
| 1,332,301 | 3/1920 | Moore . | |
| 1,396,616 | 11/1921 | Alleigh . | |
| 1,767,842 | 6/1930 | Gehrke | 5/494 |
| 2,130,771 | 9/1938 | Mann . | |
| 2,227,751 | 1/1941 | Idelman | 5/494 |
| 2,419,827 | 4/1947 | Elkins . | |
| 2,675,557 | 4/1954 | Kempner, Jr. | 128/134 |
| 2,701,885 | 2/1955 | Turco . | |
| 2,738,512 | 3/1956 | Winer . | |
| 3,079,611 | 3/1963 | Boryszewski | 2/69 |
| 4,142,264 | 3/1979 | Whiting | 2/69.5 |
| 4,240,159 | 12/1980 | Wrightson . | |

FOREIGN PATENT DOCUMENTS

| | | |
|---|---|---|
| 597979 | 9/1959 | Italy . |

*Primary Examiner*—Alexander Grosz
*Assistant Examiner*—Michael F. Trettel
*Attorney, Agent, or Firm*—Majestic, Gallagher, Parsons & Siebert

[57] ABSTRACT

A child's bedding is provided which has a flat, generally rectangular blanket portion. A pair of spaced-apart straps are attached to the top edge of the blanket. The straps are adjustable both vertically as well as laterally. A plurality of fasteners permit alternate rows of fasteners to be engaged thereby allowing the bedding to adjust to different size children. A sewn-in pleat further adds to adjustability by allowing the bedding to be lengthened. Fasteners at the bottom of the bedding provide warmth and keep the child from kicking off the bedding. Lastly, a centrally disposed fastener provides a means to secure the child in a maximum vertical position.

5 Claims, 6 Drawing Figures

BEDDING FOR CHILDREN

BACKGROUND OF THE INVENTION

1. Field of the Invention

This invention relates to an improvement in children's bedding. More particularly, this invention relates to bedding for children having fastening means for improved adjustability as well as improved security.

2. Description of the Prior Art

A number of sleeping bags for children are extant in the prior art. These prior art sleeping bags have a number of disadvantages. A primary disadvantage is that they lack adjustability to accommodate children of different sizes. A second disadvantage is that they lack security means to position a child properly and securely.

It is therefore the primary object of this invention to provide a child's bedding that is adjustable to accommodate different size children, and secure as to the child's position within the bedding.

It is a further object to provide a child's sleeping bedding that has fastener members allowing adjustability and security.

SUMMARY OF THE INVENTION

Heretofore, prior art bedding has sought to provide additional warmth for a child or baby whose during-sleep movement likely uncovers it. The usual bag-like structure poses a problem in that a child could slide downward into the bag which could interfere with normal breathing. The centrally disposed fastener of this invention provides a means to secure the child in a maximum vertical position to attempt to minimize any such possibility.

The bedding of this invention comprises a generally rectangular blanket having a plurality of fasteners thereon. A pair of adjustable straps are located on the top edge of the blanket and are adapted to fit over the child's shoulders. The straps are adjustable both vertically as well as laterally. A generally centrally disposed fastener is adapted to secure the bedding between the child's legs so as to prevent the bedding from being displaced upwardly and uncovering the child. A plurality of fasteners are located on the bedding to permit adjusting for different size children and to accommodate infant growth. A sewn-in pleat at the bottom of the bedding may be let down so as to lengthen the bedding. Fasteners at the bottom of the bedding permit closure of the bottom of the bedding so as to provide warmth and keep the bedding from being kicked off.

Further and other objects and advantages will become apparent from a review of the following description and drawings.

DETAILED DESCRIPTION OF THE INVENTION

Figure 1A:
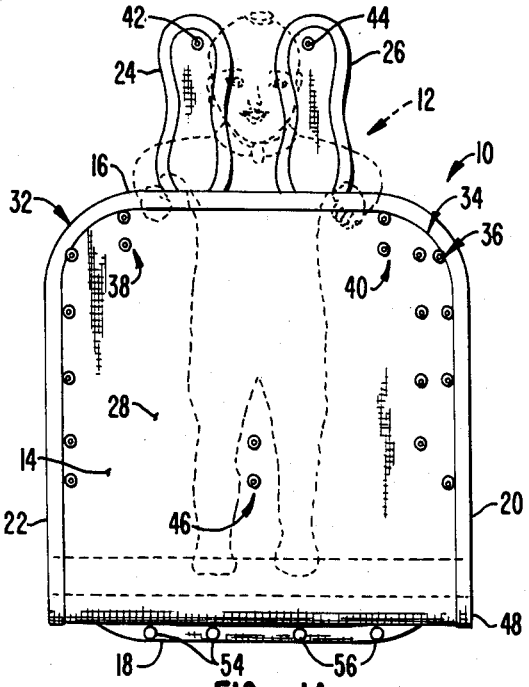
FIG. 1A is a plan view of the inventive bedding in the opened position for receiving a child.

As shown in FIG. 1A, the bedding 10 is in the opened or flat position for receiving a child 12 thereon. The bedding comprises a flat, generally rectangular blanket 14 of cloth or other suitable material.

The blanket 14 defines top and bottom, right and left edges 16, 18, 20, 22, respectively. The blanket edges may be rolled and sewn as shown. Fixed to the top edge 16 by sewing or other suitable means are a pair of spaced apart straps 24, 26. The blanket 14 also defines an inner face 28 and an outer face 30.

A plurality of fasteners are mounted on the bedding. These fasteners may be the common "snap" type of fastener having cooperative male and female kinds. Alternatively, other equivalent fastening means may be used such as ties, buttons, hooks, Velcro tape, or zippers.

Figure 1B:
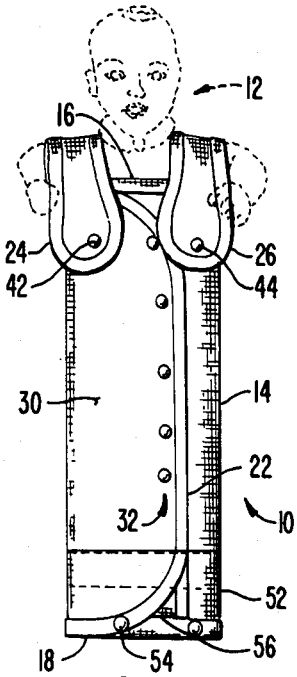
FIG. 1B is a view of the bedding similar to FIG. 1A showing the bedding in use and folded around a child.
Figure 2A:
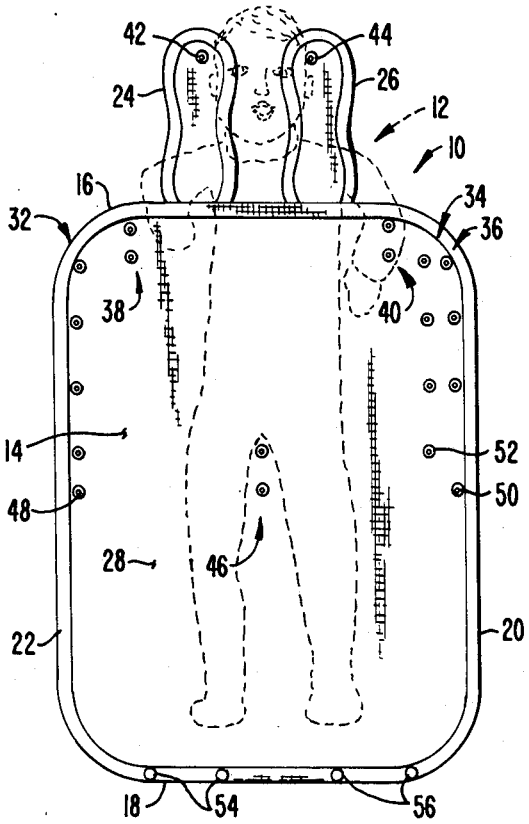
FIG. 2A is a view similar to FIG. 1A showing the sewn-in pleat let down to lengthen the bedding.
Figure 2B:
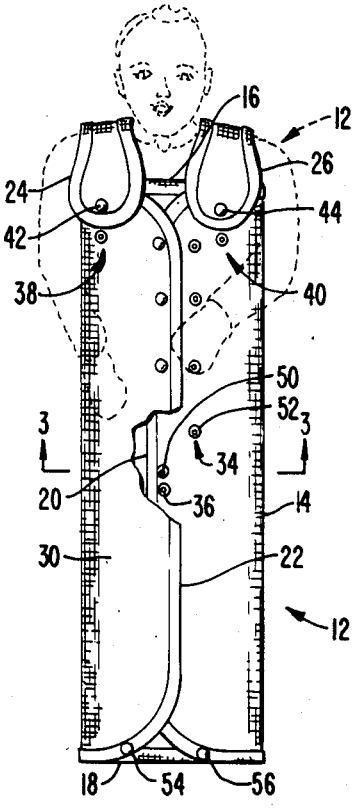
FIG. 2B is a view similar to FIG. 1B, partially cut away, showing the bedding fasteners adjusted to accommodate a larger child.

A row of spaced fasteners 32 is located along the left edge 22. A pair of rows of spaced fasteners 34, 36 is located along the right edge 20 of the bedding 10. By comparing FIGS. 1B and 2B, it may be seen that the bedding is laterally adjustable to accommodate different size children.

The bedding is also longitudinally adjustable by means of two pair of fasteners 38, 40 that are located in spaced apart relation adjacent the top edge 16 of the bedding. Again comparing FIGS. 1B and 2B, it may be seen that fasteners 42, 44 on straps 24, 26, respectively, may be fastened to first the lowermost and then the uppermost of the fastener pairs 38, 40.

Further adjustability is provided by having the lowermost of fastener pair 40 laterally offset from the uppermost fastener. This allows strap 26 to be adjusted laterally by moving it from the leftmost fastener of fastener pair 41 to the rightmost as viewed in FIG. 1A. This permits the straps to be adjusted both vertically as well as laterally.

Figure 3:
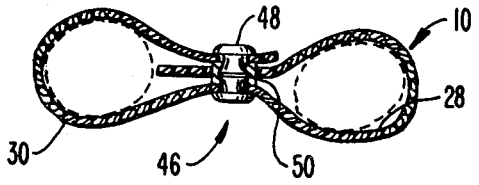
FIG. 3 is a cross-sectional view taken along lines 3—3 in FIG. 2B showing details of the central retaining fastener.

Also aiding adjustability are a pair of generally centrally disposed fasteners 46 which mate with fasteners in rows 32, 34 and 36 so as to keep the bedding from moving up on the child. FIG. 3 illustrates how the fasteners interact to secure the bedding with, in this case, the lowermost fastener of pair 46 and the lowermost fastener of rows 32 and 36 interengaging to secure the bedding in the area of the child's crotch. As may be seen, the fasteners 50, 52 are of the double "female" type. The mating fasteners 48, 50 are if the "male" type.

Figure 4:
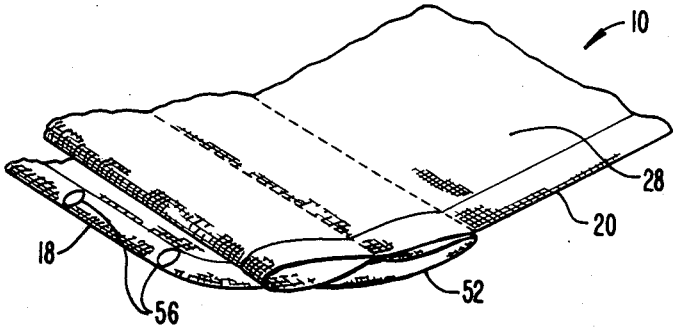
FIG. 4 is an enlarged partial view of the bottom edge of the bedding showing details of the sewn-in pleat.

As best seen in FIG. 4, a sewn-in pleat 52 permits the bedding to be lengthened. To do so, the stitching is simply removed. Again comparing FIGS. 1B and 2B, the effect of taking out the pleat may be seen. While stitching has been described, it may be understood that equivalent fastening means may also be used. For example, snap fasteners could be used in lieu of stitching.

Finally, a pair of mating snap fasteners 54, 56 are located on the lower edge or bottom of the bedding so that the bottom may be closed to provide warmth and keep the bedding from being kicked off.

While the invention has been described in conjunction with a preferred embodiment thereof, it will be understood that the description is intended to illustrate and not limit the scope of the invention, which is to be defined by the scope of the appended claims.

I claim:

1. A child's bedding comprising a generally rectangular, flat blanket portion defining top, bottom, right and left edges, and further including fastener means thereon, said fastener means comprising a row of fasteners along said left edge and a plurality of spaced apart rows of mating fasteners along said right edge so that the left edge fasteners may be alternately engaged with one of said rows of fasteners along said right edge so as to provide lateral adjustability to the bedding, a pair of spaced-apart straps attached to the top edge of said bedding at one end thereof, and further including fasteners on the free ends of said straps alternately engageable with a plurality of fasteners on the top edge of said bedding so as to provide vertical adjustability to the bedding, and central fastening means generally centrally disposed on said blanket portion for providing vertical adjustable security to said bedding, thereby securing the child in proper position.

2. The invention of claim 1 further including means for lengthening said blanket comprising a longitudinal pleat and releasable means holding said pleat in position.

3. The invention of claim 2 wherein said releasable means holding said pleat comprises stitching or equivalent fastening means.

4. The invention of claim 1 wherein the fastener means further comprises at least one pair of fasteners located adjacent the bottom edge of said bedding so as to permit closing off of the bottom of said bedding.

5. The invention of claim 1 further including a fastener removably attaching one of said straps to the top edge of said bedding at the end of said strap opposite said free end so that said one of said straps may be adjusted laterally.

* * * * *